United States Patent [19]

Hayashi et al.

[11] Patent Number: 4,659,882

[45] Date of Patent: Apr. 21, 1987

[54] SLIDE SWITCH

[75] Inventors: Kazuhiko Hayashi, Aichi; Masayosi Iwata; Mikio Tada, both of Gifu; Hirotoshi Mizuno, Aichi, all of Japan

[73] Assignee: Toyota Jidosha Kabushiki Kaisha, Aichi, Japan

[21] Appl. No.: 799,818

[22] Filed: Nov. 20, 1985

[30] Foreign Application Priority Data

Nov. 21, 1984 [JP] Japan ..... 59-177232[U]

[51] Int. Cl.[4] ..... H01H 3/00; H01H 15/02

[52] U.S. Cl. ..... 200/16 R; 200/153 LA

[58] Field of Search ..... 200/5 A, 16 R, 153 L, 200/153 LA, 157, 159 B

[56] References Cited

U.S. PATENT DOCUMENTS

| | | | |
|---|---|---|---|
| 3,983,355 | 9/1976 | Hyodo | 200/16 R X |
| 4,114,000 | 9/1978 | Feder | 200/16 R |
| 4,324,956 | 4/1982 | Sakakino et al. | 200/16 R |
| 4,367,379 | 1/1983 | Tome | 200/16 R X |
| 4,506,118 | 3/1985 | Mollman | 200/16 R X |
| 4,590,338 | 5/1986 | Suzuki | 200/16 R X |

*Primary Examiner*—J. R. Scott

*Attorney, Agent, or Firm*—Finnegan, Henderson, Farabow, Garrett and Dunner

[57] ABSTRACT

A slide switch comprising a slidable knob having a slanting surface formed in its inside, a holder arranged to be moved by the slanting surface in the direction perpendicular to the sliding direction of the knob, an insulator plate disposed in the direction perpendicular to the moving direction of the holder and provided with fixed contacts on the holder side, a first elastic body disposed on the insulator plate and provided with an opening portion widely opened toward the insulator plate and with a movable contact on an inner surface opposite to the fixed contacts, and a second elastic body interposed between the holder and the first elastic body and having an elastic modulus larger than that of the first elastic body.

5 Claims, 5 Drawing Figures

SLIDE SWITCH

FIELD OF THE INVENTION AND RELATED ART STATEMENT

The present invention relates to a slide switch in which a contact is turned on/off by sliding an operation knob and more particularly relates to a slide switch in which a slide resistance at a contact is eliminated.

FIG. 5 is a cross-section showing a conventional slide switch having a basic structure to which the present invention is applied. An insulator plate 12 having a pair of fixed contacts provided at the inside thereof is fixed on a bottom surface of a body 10. A knob 14 is provided on the upper surface of the body 10 so as to be slidable in a direction of an arrow and one end of a holder 16 extending toward the insulator plate 12 is fixed in the inside of the knob 14. The holder 16 is formed with an opening portion opened toward the insulator plate 12 and a movable contact 20 normally urged by a spring 18 toward the insulator 12 is inserted into the opening portion.

In the thus arranged slide switch, if the knob 14 is slid right in the drawing, the holder 16 is slid as the knob 14 slides. The sliding of the holder 16 causes the moveable contact 20 to slide on the insulator plate 12 and when the movable contact 20 comes to contact with the pair of fixed contacts the switch is turned on.

In the conventional slide switch described above, however, there is such a problem that there occurs a hitched feeling when the movable contact rides on the end surfaces of the fixed contacts because the slide switch is arranged such that the movable contact is slid to come into contact with the fixed contacts. There is such a further problem that there is a risk of occurence of an undesirable condition in returning the knob due to a slide resistance between the movable contact and the insulator. Also, a frictional resistance is caused between the body and the holder when the holder is inclined, and it is therefore necessary to increase the spring constant of a return spring to thereby increase the operation force. However, the contact force between contacts cannot be made so large even if the operation force is made large and it is impossible to make the contact stable.

OBJECT AND SUMMARY OF THE INVENTION

It is therefore an object of the present invention to provide a slide switch in which a movable contact is held without any sliding movement to thereby solve the foregoing problems.

In order to attain the above-mentioned object, according to the present invention, the slide switch comprises a slidable knob having a slanting surface formed in its inside, a holder arranged to be moved by the slanting surface in the direction perpendicular to the sliding direction of the knob, an insulator plate disposed in the direction perpendicular to the moving direction of the holder and provided with a fixed contact on the holder side, a first elastic body disposed on the insulator plate and provided with an opening widely opened toward the insulator plate and with a movable contact on an inner surface opposite to the fixed contact, and a second elastic body interposed between holder and the first elastic body and having an elastic modulus larger than that of the first elastic body.

According to the present invention, if the knob is slid by applying operation force thereto, the holder is moved in the direction perpendicular to the sliding direction of the knob owing to the slanting surface formed on the knob so that the knob urges the first elastic body through the second elastic body. The urging by the holder deforms the wall surface of the opening portion of the first elastic body so as to move the movable contact toward the fixed contact to come into contact with the latter to thereby turn the switch on.

Since the elastic modulus of the second elastic body is made larger than that of the first elastic body, the first elastic body is deformed largely than the second elastic body when operation force is applied. Accordingly, if the operation force is further applied even after the first elastic body has been deformed and the movable contact has come in contact with the fixed contact, the second elastic body is deformed to increase the contact force between the contacts. Further, if the knob is returned into the original state, the second elastic body returns into its original state by its restoration force and then the first elastic body returns into its original state to thereby turn the slide switch off.

DETAILED DESCRIPTION OF THE PREFERRED EMBODIMENTS

Figure 1:
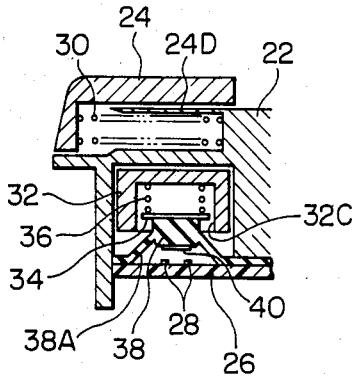
FIG. 1 is a cross-section along I—I line in FIG. 2.
Figure 2:
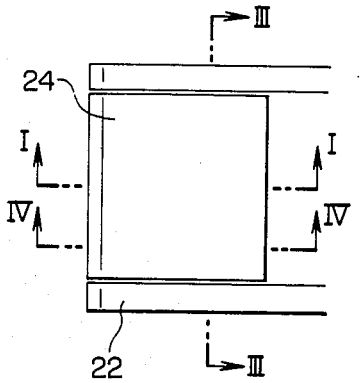
FIG. 2 is a plan view of an embodiment of the present invention.
Figure 3:
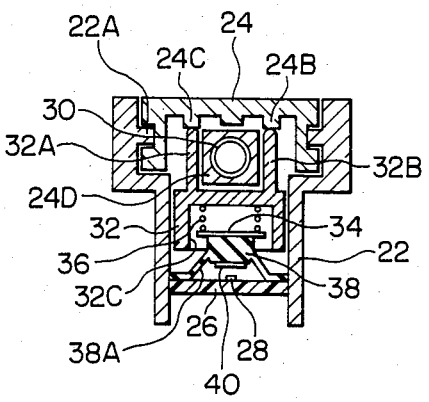
FIG. 3 is a cross-section along line III—III in FIG. 2.
Figure 4:
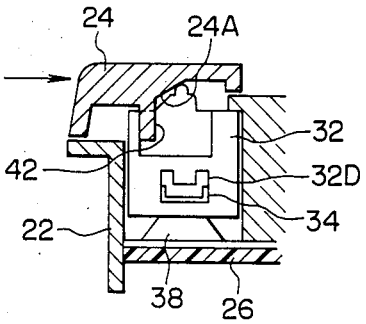
FIG. 4 is a cross-section along line IV—IV in FIG. 2.
Figure 5:
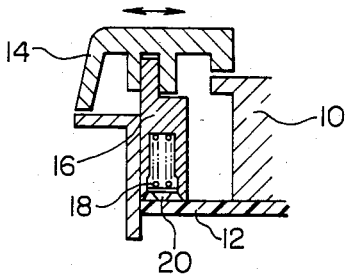
FIG. 5 (PRIOR ART)
FIG. 5 is a cross-section of a conventional slide switch.

Referring to the drawings, an embodiment of the present invention will now be described in detail. FIG. 2 is a plan view of the embodiment, FIG. 1 is a cross-section along line I—I in FIG. 2, FIG. 3 is a cross-section along line III—III in FIG. 2, and FIG. 4 is a cross-section along line IV—IV in FIG. 2. Inside a body 22 formed with a hollow portion therein, an insulator plate 26 provided at the inside thereof with a pair of fixed contacts 28 is fixed so as to form a bottom of the body 22. A knob 24 is provided on the upper surface of the body 22. The knob 24 is formed with grooves in its opposite outer side wall surfaces, the grooves extending in the sliding direction and fitted with protrusions 22A formed on the inner side wall surfaces of the body and extending in the sliding direction, thereby making the knob slidable. On the inside of the upper wall of the knob 24, there are provided protrusions 24B and 24C each extending in the sliding direction and having a slanting surface 24A.

In the hollow portion of the body 22, there is formed a projecting portion 24D having a width narrower than the distance between the protrusions 24B and 24C and extending in the sliding direction of the knob. A hole 100 extending in the sliding direction of the knob is formed in the projecting portion 24D and a return spring 30 is inserted through hole 100 so that the knob 24 and the body 22 are normally urged in the direction to separate the knob 24 and the body 22 from each other.

A holder 32 is inserted into the hollow portion of the body 22. The holder 32 is formed at its upper portion with slide portions 32A and 32B which abut against the respective slanting surfaces 24A formed on the protrusions 24B and 24C of the knob 24, and is formed at its lower portion with an opening portion 32C. Into the opening portion 32C of the holder 32, inserted is a plate 34 having opposite ends engaged with respective holes 32D formed in the side wall of the holder, a spring 36 acting as a second elastic body being interposed between the plate 34 and the inner wall of the holder 32.

A first elastic body 38 made of an insulating material such as rubber is sandwiched between the plate 34 and the insulator plate 26. A funnel-shaped opening portion 38A opened widely toward the insulator plate 26 is formed in the elastic body 38. The lower outer peripheral portion of the elastic body 38 is sandwiched between the insulator plate 26 and the body 22. The elastic modulus of the spring 36 is selected to be larger than that of the elastic body 38. A movable contact 40 is fixed on the inner surface of the elastic body 38 in opposition to the fixed contacts 28 and the distance between the fixed contacts 28 and the movable contact 40 is selected to be smaller than the distance of movement of the knob 30. The reference numeral 42 designates a stop for preventing the knob from being pulled apart from the body.

The operations of the above-mentioned embodiment will now be described. When the knob 24 is slid in the direction of the arrow in FIG. 4 against the elastic force of the return spring 30, the slide portions 32A and 32B of the holder 32 are urged by the slanting surfaces 24A of protrusions 24B and 24C of the knob 24 so as to move the holder in the direction (downward in the drawing) perpendicular to the sliding direction of the knob. The elastic body 38 is urged by the moving plate 34 through the spring 36 and the holder 32 so that the thin portion of the elastic body forming the opening 38A causes the movable contact 40 to contact with the fixed contacts 28 to thereby turn the slide switch on. The click load generated upon deformation of the elastic body 38 at this time is transmitted as a nodular feeling to the knob through the spring 36 and the holder 32. Since the elastic modulus of the spring 36 is selected to be larger than that of the elastic body 38, the amount of compression of the spring 36 is smaller than that of the elastic body 38. When the knob 24 is further slid, the spring 36 is further compressed so that the contact force between the movable contact and the respective fixed contacts is increased to thereby make the contact between the contacts stable. On the other hand, if the operation force exerting on the knob is released, the knob is returned to its original state, that is to the postion where the stop 42 abuts against the holder 32, by the elastic force of the return spring 30. The spring 36 returns to its original state by its recovery force, and the elastic body 38 also returns its original state, so that the slide switch is turned off and the holder is returned to its original position.

As described above, according to the present invention, since the second elastic body having an elastic modulus larger than that of the first elastic body is interposed between the first elastic body and the holder, it is possible to produce contact force proportional to the operation force to thereby make stable the contact between the contacts. Further, since the click load due to deformation of the first elastic body is transmitted to the knob, it is possible to obtain a nodular feeling without providing any particular nodular mechanism.

we claim:

1. A slide switch comprising:

a stationary body having a hollow portion; a knob and first biasing means for biasing said knob conjointly mounted to and relatively movable with respect to said stationary body;

a holder means for holding a movable contact therein, said holder means being movably disposed in said hollow portion of said stationary body;

an insulating plate having fixed contacts opposing said movable contact, said insulating plate being fixed to said stationary body;

movement translating means for translating a first movement of said knob into a second movement of said holder means, the direction of said first movement being perpendicular to the direction of said second movement;

a second biasing means disposed on said insulating plate and providing supporting means for said movable contact;

a third biasing means within said holder means series connected to said second biasing means for additionally biasing said movable contact and said holder means relative to said fixed contacts and said knob, said third biasing means having an elastic modulus larger than that of said second biasing means.

2. The slide switch according to claim 1, wherein said first biasing means comprises a coil spring.

3. The slide switch according to claim 3, wherein said second biasing means comprises an elastic member.

4. The slide switch according to claim 3, wherein said elastic member of said second biasing means is funnel-shaped.

5. The slide switch according to claim 1, wherein said movement translating means includes a slanting surface portion formed on an inner surface of said knob, and a slide portion formed on said holder to contact said slanting surface portion when said knob is moved in the direction of said first movement to thereby move said holder in the direction of said second movement perpendicular to the direction of said first movement of said knob.

* * * * *

UNITED STATES PATENT AND TRADEMARK OFFICE

CERTIFICATE OF CORRECTION

PATENT NO. : 4,659,882

DATED : 4/21/87

INVENTOR(S) : Kazuhiko Hayashi et al.

It is certified that error appears in the above-identified patent and that said Letters Patent is hereby corrected as shown below:

The assignee's should be noted as:

TOYOTA JIDOSHA KABUSHIKI KAISHA and KABUSHIKI KAISHA TOKAI RIKA DENKI SEISAKUSHO, both of Aichi, Japan Signed and Sealed this Eighth Day of September, 1987

*Attest:*

DONALD J. QUIGG

*Attesting Officer*

*Commissioner of Patents and Trademarks*